United States Patent [19]

Echelson

[11] Patent Number: 4,913,326

[45] Date of Patent: Apr. 3, 1990

[54] ARMBAND CARRIER FOR AUDIO DEVICES

[76] Inventor: Jack L. Echelson, 7807 Eagles Flight La., Ft. Myers, Fla. 33912

[21] Appl. No.: 330,757

[22] Filed: Mar. 30, 1989

[51] Int. Cl.[4] ..... A45C 11/00

[52] U.S. Cl. ..... 224/222; 224/267

[58] Field of Search ..... 224/222, 219, 245, 249, 224/250, 251, 254, 267; 455/100, 89, 344

[56] References Cited

U.S. PATENT DOCUMENTS

| | | | |
|---|---|---|---|
| D. 259,220 | 5/1981 | Small et al. | 224/219 |
| 1,689,396 | 10/1928 | Lang | 224/222 |
| 1,728,365 | 9/1929 | Root et al. | 224/222 |
| 4,061,256 | 12/1977 | Beer, et al. | 224/219 |

FOREIGN PATENT DOCUMENTS

| | | | |
|---|---|---|---|
| 6866 | 3/1916 | United Kingdom | 224/219 |

*Primary Examiner*—Renee S. Luebke

*Attorney, Agent, or Firm*—Merrill N. Johnson

[57] ABSTRACT

A carrier for a portable audio device to be worn on the upper arm of an individual. The carrier has an open top to receive the portable radio or similar audio device and is made of fabric in the shape of an open-topped rectangular box with a length of elastic tape sewn in the tape's stretched position into the inside of the front horizontal midsection of the carrier, the elastic band designed to hold the audio device in place within the carrier. The carrier is joined to a circular band of elastic material designed to fit snugly about the upper arm of an individual thereby permitting the audio device to be carried securely on the individual's upper arm.

2 Claims, 1 Drawing Sheet

ARMBAND CARRIER FOR AUDIO DEVICES

BACKGROUND AND SUMMARY OF THE INVENTION

My invention lies in the field of carriers for portable audio equipment, particularly small radio receivers often used by joggers and walkers who wish to hear sound either directly from the receiver or by an ear phone attached by a cable to the radio receiver.

My invention is also useful to persons who want to hear audible sounds while at the same time require full use of their hands as for driving or skiing.

Relatively recent prior art patents establish the advantages of positioning the portable audio device close to the individual's ear and especially on or near the individual's upper arm. U. S. Pat. Nos. 4,135,653; 4,432,477; and 4,500,019 all relate to holders or carriers for portable radios mounted on or about the upper arm. And U.S. Pat. No. 4,509,667 discloses a camera carrier mounted on an armband designed to encircle the cameraman's upper arm.

While the specific equipment carriers shown in the prior art securely contain the portable radio, thus insuring against accidental damage to or loss of the portable audio device, the carriers appear quite cumbersome to use and expensive to manufacture.

I have invented a unique carrier for portable audio devices designed to be mounted on or about the wearer's upper arm. My carrier contains no buckles, fasteners, zippers or other mechanical devices for securing the portable audio device within the carrier. My carrier is made of fabric which is cut and sewn into an open-topped rectangular box. As shown in the drawings attached hereto, a length of elastic tape is stretched and as stretched is sewn into the inside of the front horizontal midsection of the carrier. In use, the presence of the stretched elastic band pressing against the portable radio receiver within the carrier serves as a restraint against accidental removal or loss or damage to the radio receiver itself.

The open-topped fabric container is attached preferably by sewing to a wide closed circular band of elastic material sized to fit snugly about the upper arm of an individual, thus permitting the audio device to be carried securely on the individual's upper arm and near his or her ear.

DETAILED DESCRIPTION OF THE PREFERRED EMBODIMENT

Figure 1:
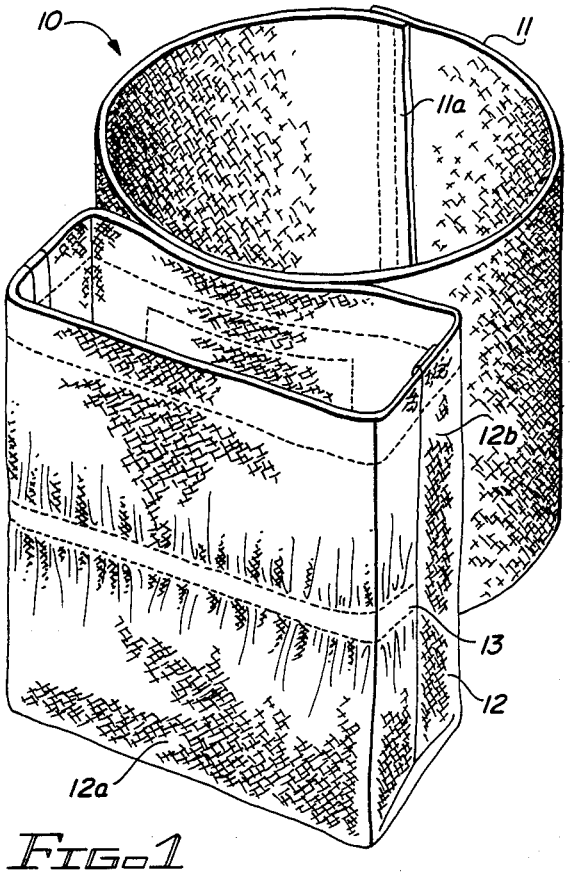
FIG. 1 is a perspective view taken from above of a preferred embodiment of my carrier for a portable radio receiver carried on the upper arm of an individual.
Figure 2:
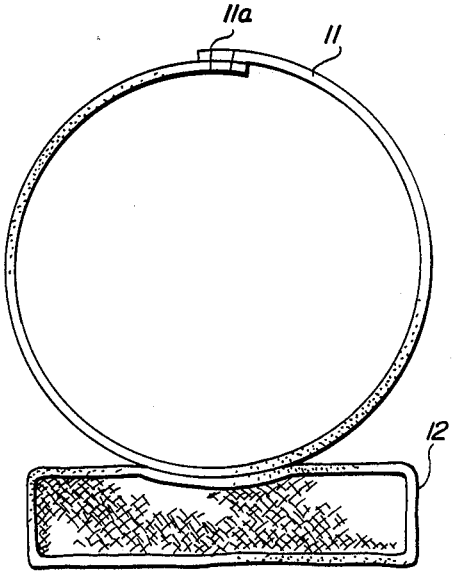
FIG. 2 is a plan view taken from above of the radio receiver carrier shown in FIG. 1.
Figure 3:
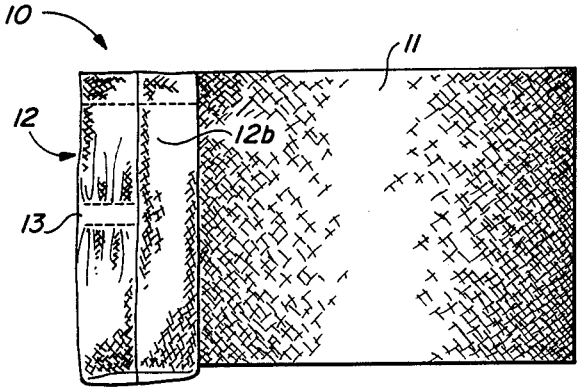
FIG. 3 is a right side elevational view of the carrier shown in FIGS. 1 and 2.

Referring to the drawings, FIGS. 1, 2 and 3 show my carrier assembly 10 which in brief consists of an arm encircling closed elastic band 11 and an open-topped carrier 12.

Band 11 is made in various sizes to fit comfortably over the bare or clothed upper arm of an individual. Preferably band 11 is made of one-way stretch elastic material 4 inches wide and 11 inches long sewn along its width by stitching 11*a* into a closed cylinder approximately 3½ inches in diameter.

Carrier 12 is an open-topped rectangular box having a front face 12*a*, two sides 12*b* and a rectangular bottom panel whose dimensions are the same as those of the carrier's open top. Carrier 12 is preferably made of one or more pieces of woven fabric. While the carrier can be made in various sizes to accomodate portable audio devices of different size, I have found a carrier about 4½ inches high with an open top 4 inches across and one inch wide will comfortably contain a great majority of the portable radio receivers on the market today.

In order to securely hold the radio receiver within carrier 12, I employ a length of one-way stretch elastic tape 13 sewn into the inside of the front 12*a* of the carrier horizontally along the carrier's midsection as shown in FIGS. 1 and 3. In the preferred embodiment, tape 13 is ⅜ths of an inch wide and 3 inches long unstretched and about five inches long when stretched. The tape is sewn into the inside of the front half of the carrier when fully stretched, creating a gathered condition of the carrier's fabric along the front face 12*a* of the carrier as shown in FIGS. 1 and 3.

Thus when a portable radio receiver is inserted into carrier 12, the elastic tape 13 and the carrier's front face 12*a* expand horizontally against the radio receiver to hold it in place within the carrier. The use of elastic tape 13 secures the radio receiver in the carrier even when the individual is jogging or engaged in exercises or other activity in which the individual's forearms are elevated to the level of his or her head.

Carrier 12 is permanently attached to elastic band 11 preferably by horizontal and vertical stitching along the back face of the carrier as best shown in FIG. 1 of the drawings, but other means of joining the back face of the carrier to the outside of band 11 may be employed.

The foregoing detailed description of the preferred embodiment is illustrative and not intended to limit my invention in any way. Those skilled in the art may suggest various changes and modifications which fall within the spirit of my invention, whose scope is limited only by the appended claims.

I claim:

1. A carrier assembly for carrying a portable audio device designed to be worn on the upper arm of an individual comprising an arm encircling closed cylindrical elastic band and an open-topped carrier made of non-stretchable fabric and having rectangular front and back faces, two rectangular sides and a rectangular bottom panel whose dimensions approximate those of the carrier's open top, the two sides and front face of the carrier each having a midsection lying equidistant from the top and bottom of the carrier, the carrier's back face being permanently joined to the outside of the cylindrical elastic band so that the open top and bottom panel of the carrier lie in planes parallel to the open top and bottom of the cylindrical elastic band, and a one way stretchable elastic tape sewn in its stretched condition into the inside of the front half of the carrier horizontally across the midsection of the front face and the two sides of the carrier causing the fabric of the front half of the carrier to gather along its midsection when the elastic tape returns to its unstretched condition.

2. A carrier assembly for carrying a portable audio device designed to be worn on the upper arm of an individual comprising an arm encircling closed cylindrical one-way stretch elastic band having a diameter of approximately 3½ inches in its unstretched condition, an open-topped carrier made of woven non-stretchable fabric and having rectangular front and back faces approximately 4 inches wide and 4½ inches high, two rectangular sides approximately one inch wide and 4½ high and a bottom panel approximately one inch wide and 4 inches long.

the front face and two sides of the carrier each having a midsection lying equidistant from the top and bottom of the carrier, the carrier's back face being permanently joined to the outside of the cylindrical elastic band so that the open top and bottom panel of the carrier lie in planes parallel to the open top and bottom of the cylindrical elastic band, and a one-way stretchable elastic tape approximately ⅜ths of an inch wide and 3½ inches long in its unstretched condition sewn in its stretched condition into the inside of the front half of the carrier horizontally across the midsection of the front face and the two sides of the carrier, thus causing the woven fabric of the front half of the carrier to gather along its midsection when the elastic tape returns to its unstretched condition.

* * * * *